US006231040B1

(12) United States Patent
Langenegger

(10) Patent No.: US 6,231,040 B1
(45) Date of Patent: May 15, 2001

(54) SUCKER HEIGHT ADJUSTMENT MECHANISM

(75) Inventor: Daniel Langenegger, Bethlehem, PA (US)

(73) Assignee: Graphic Management Associates, Inc., Bethlehem, PA (US)

( * ) Notice: Subject to any disclaimer, the term of this patent is extended or adjusted under 35 U.S.C. 154(b) by 0 days.

(21) Appl. No.: 09/460,119

(22) Filed: Dec. 13, 1999

(51) Int. Cl.[7] ..... B65H 3/08
(52) U.S. Cl. ..... 271/107; 271/100
(58) Field of Search ..... 271/97, 100, 103, 271/107

(56) References Cited

U.S. PATENT DOCUMENTS 3,980,292 * 9/1976 Sakurai ..... 271/107
5,052,672 * 10/1991 Horii ..... 271/11
5,076,565 * 12/1991 Liepert ..... 271/107
5,120,041 * 6/1992 Schniter ..... 271/107

* cited by examiner

*Primary Examiner*—H. Grant Skaggs
(74) *Attorney, Agent, or Firm*—Jordan B. Bierman; Bierman, Muserlian and Lucas

(57) ABSTRACT

A sucker adjustment device including a moving lever having a cam surface adjacent its far end. An axis is located adjacent the near end and a first cam follower is mounted intermediate the ends. The first cam follower bears against an actuating cam which causes the former to move between an extended position, wherein the sucker cup attached thereto contacts the bottom newspaper of a stack, and a retracted position, wherein the sucker cup is out of the path of the lowest newspaper. There is an actuating lever pivotally mounted about the axis and carrying an arm between its distal end and the axis. There is a second cam follower on the arm at a point remote from the actuating lever and bearing against the cam surface. A pivot adjacent the rotating end of the sucker bar spaced apart from the sucker cup permits the sucker bar to move between its extended and retracted positions. By this means, appropriate movement of the actuating lever will adjust the extended position of the sucker cup with respect to the newspapers without changing its retracted position.

4 Claims, 3 Drawing Sheets

SUCKER HEIGHT ADJUSTMENT MECHANISM

The present Invention is an adjunct to machines which handle stacks of flat products, particularly newspapers. These are normally placed in stacks and one of the functions of the machines is to remove one paper at a time from the stack. This is accomplished by movement of a vacuum sucker which contacts the lowest newspaper in the stack and pulls it down into the machine. Since there are a number of variables in determining the precise relationship between the extreme position of the vacuum sucker and the stack of newspapers, it is desirable to have a device which is capable of being adjusted in this regard. Moreover, since the machines are large and operate at high speeds, it is even more desirable that this adjustment be capable of taking place while the machine continues to operate.

SUMMARY OF THE INVENTION

As the vacuum sucker goes through its entire cycle, it moves up to and preferably contacts the lowermost newspaper of the stack; the vacuum is applied and the sucker retracts, carrying at least a corner of the newspaper with it. This enables the desired separation to be made. The vacuum is then released and the sucker moves back toward the stack to remove the next newspaper. The present Invention is a means of adjusting the extended position of the sucker cup without changing its retracted position.

It is an object of the present Invention to provide a device which is capable of adjusting the position of the vacuum sucker nearest the stack of newspapers while the machine with which it is associated continues to operate. The sucker adjustment device of the present Invention comprises a moving lever having a cam surface adjacent its far end. There is an axis adjacent its near end, remote from the far end, and a first cam follower is located intermediate the ends. The first cam follower bears against an actuating cam.

An actuating lever is pivoted about the axis and has a distal end and a remote end remote therefrom. There is an arm having a proximal end pivotally mounted on the actuating lever between the axis and the distal end.

A second cam follower is on the arm, remote from the point at which it is attached to the actuating lever, and bearing against the cam surface. A sucker bar has the sucker cup mounted thereon and has a pivot adjacent the rotating end which is spaced apart from the sucker cup.

Rotating of the actuating cam bearing against the first cam follower causes the moving lever to pivot about the axis. The cam surface bears against the second cam follower and urges the sucker bar to pivot about its rotatable end and bring the sucker cup to a position adjacent the lowest newspaper in the stack. By pivoting the actuating lever about the axis, the arm is caused to move and the extreme position (the one closest to the newspapers) can be adjusted. It is a feature of the present Invention that, when such an adjustment is made, the retracted position of the sucker is unchanged. Moreover, the adjustment can be carried out "on the fly", i.e. while the machine is running.

In a preferred form of the device, it has been found desirable to provide a handle, mounted adjacent the distal end of the actuating lever, which can be grasped and moved to effect the desired adjustment. As previously indicated, this adjustment can be carried out without the necessity of stopping the machine.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
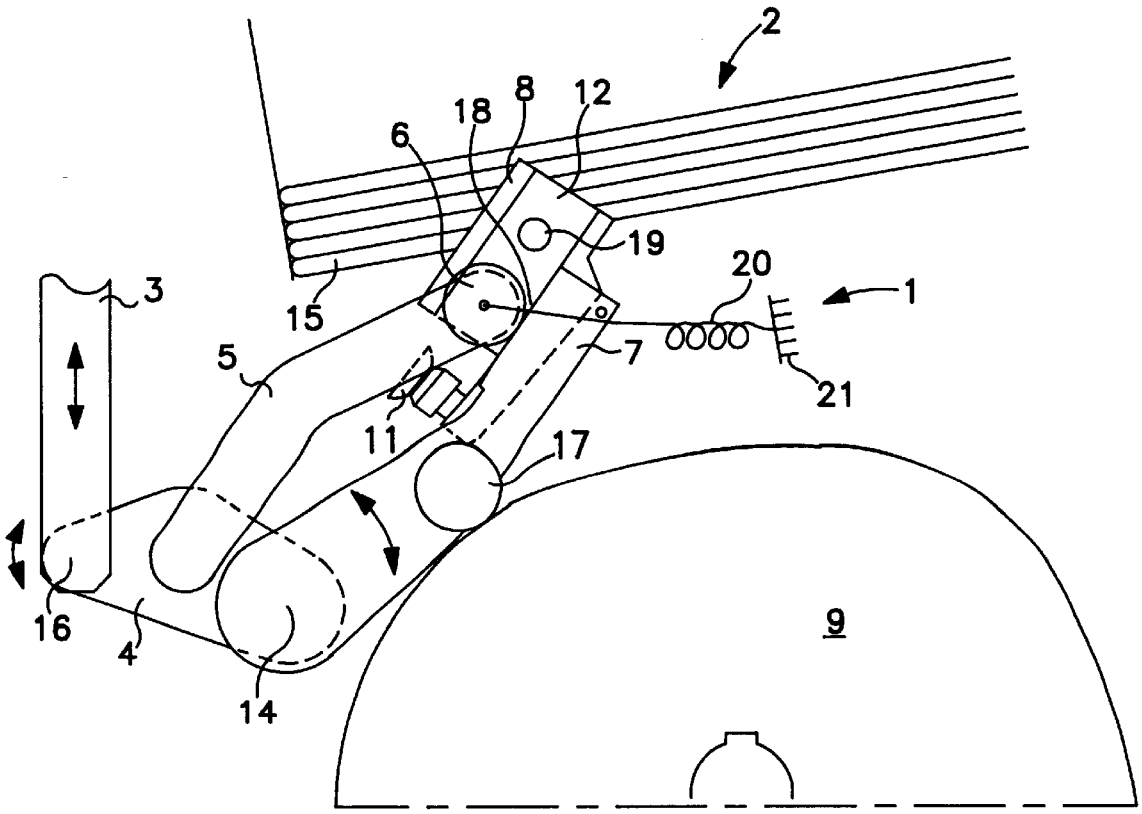
FIG. 1 is a schematic view showing the sucker cup in its retracted position.

Sucker adjustment device 1 is intended to separate the lowest newspaper 15 from the remainder of stack 2 of newspapers. Moving lever 7 is provided with first cam follower 17 and cam surface 18. The first cam follower, under the influence of spring 20 attached to frame 21, bears against actuating cam 9 which, during rotation thereof, serves to rotate moving lever 7 about axis 14.

Figure 2:
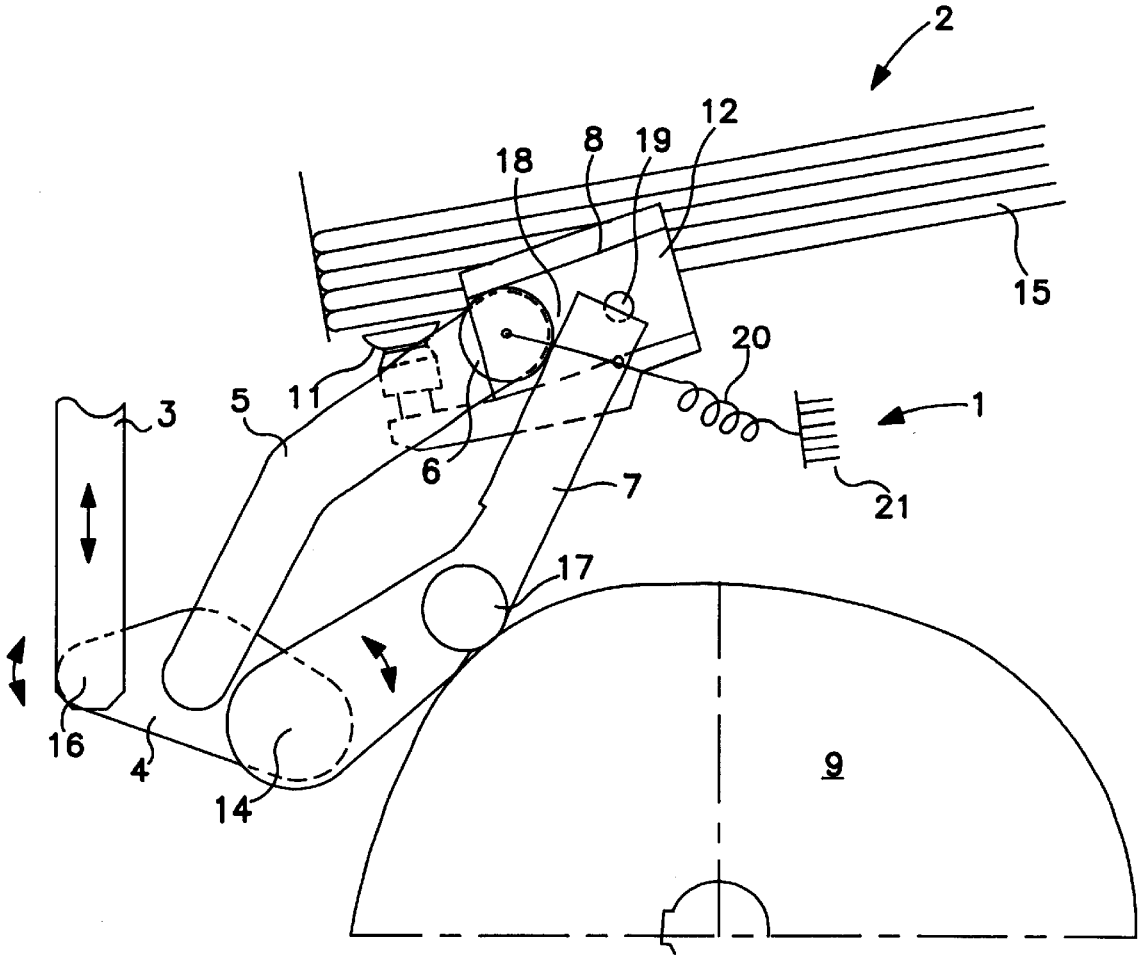
FIG. 2 is similar to FIG. 1 with the sucker cup in one extended position.
Figure 3:
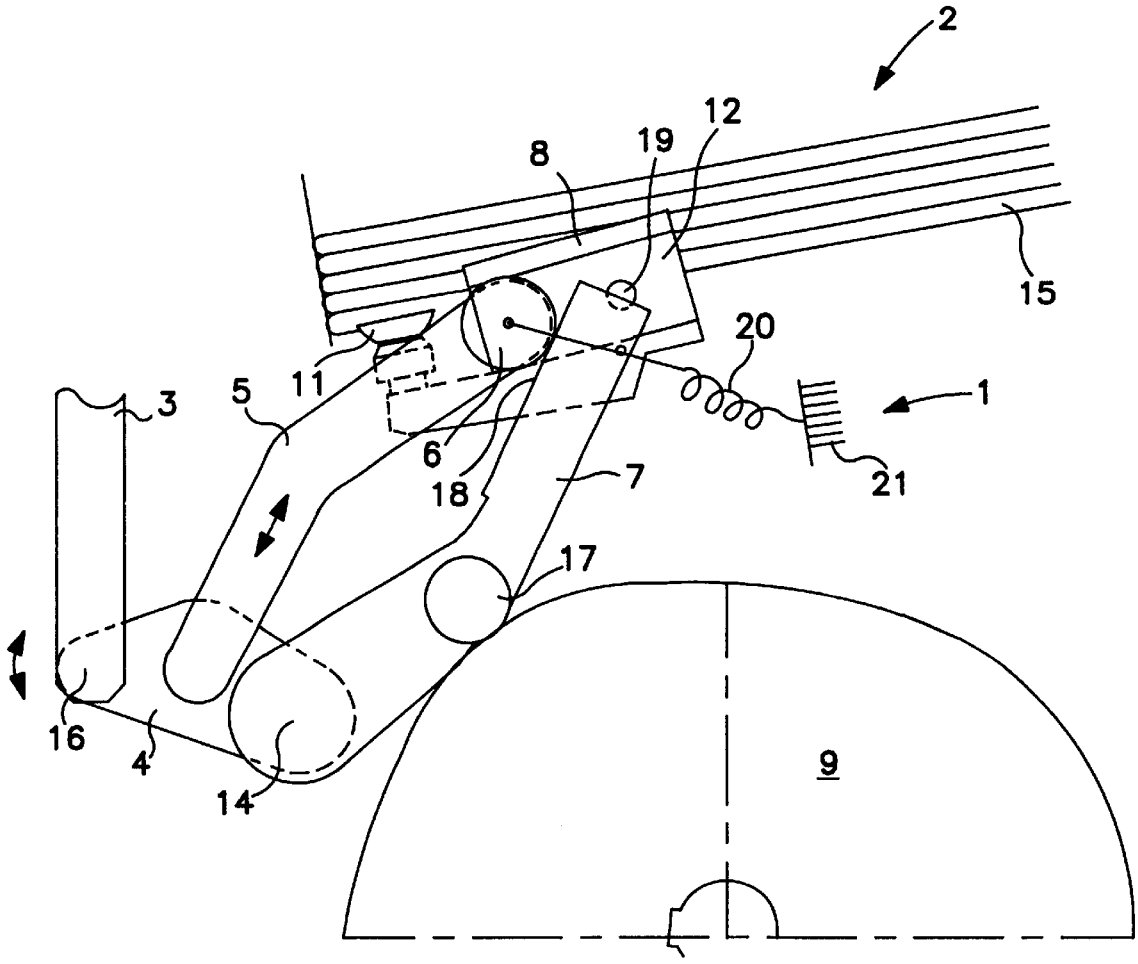
FIG. 3 is similar to FIG. 2 with the sucker cup in another, more extended, position.

When this occurs, sucker bar 8, carrying sucker cup 11, is pivoted about sucker pivot 19 from its retracted position (as shown in FIG. 1) to an extended position, such as those shown in FIGS. 2 and 3. In order to adjust the extended position, actuating lever 4 is pivotally mounted about axis 14 and, at distal end 16, carries handle 3. Between axis 14 and distal end 16 arm 5 is pivoted. The end of arm 5 remote from actuating lever 4 carries second cam follower 6 in elongated slot 12. Thus, when a vacuum is applied to sucker cup 11 in its extended position, at least the corner of lowest newspaper 15 is separated from the remainder of stack 2 whereby lowest newspaper 15 can be fed individually into a newspaper handling machine.

Thus, when handle 3 is moved upwardly, actuating lever 4 pivots about axis 14. This causes arm 5 to also move upwardly, carrying sucker cup 11 with it. When this is done, the extreme position of sucker cup 11 is changed as can be seen by comparison of FIGS. 2 and 3. However, when moving lever 7 is in the retracted position (see FIG. 1), the raising of arm 5 merely causes second cam follower 6 to slide somewhat further into elongated slot 12. Thus, the retracted position of sucker cup 11 is unchanged, regardless of the adjustment to its extreme position. Should sucker cup 11 be too close to lowest newspaper 15, moving handle 3 downward permits adjustment to the proper extreme position; here, too, the retracted position of sucker cup 11 is unchanged.

Thus, the present Invention provides a simple and reliable device for adjusting the extreme position of the sucker cup. Moreover, the adjustment can be carried out while the newspaper handling machine is operating at full speed. Since such machines operate at high speeds, a shut down for even a brief period of time can seriously impair its ability to discharge the large number of newspapers which are needed each day. The present Invention provides an adjustment that fulfills these requirements.

Although only a limited number of embodiments of the present Invention have been expressly disclosed, it is, nonetheless, to be broadly construed, and not to be limited except by the character of the claims appended hereto.

What is claimed is:

1. A sucker adjustment device comprising a moving lever having a first cam surface adjacent a far end of said moving lever, an axis adjacent a near end of said moving lever remote from said far end and a first cam follower intermediate said far end and said near end, said first cam follower bearing against an actuating cam, an actuating lever pivoted about said axis and having a distal end remote from said axis, an arm having a proximal end pivotally mounted on said actuating lever at a point between said axis and said distal end, a second cam follower on said arm, remote from said proximal end, and bearing against said cam surface, a sucker bar having a sucker cup mounted thereon, a pivot adjacent a rotating end of said sucker bar spaced apart from said sucker cup.

2. The sucker adjustment device of claim 1 wherein said second cam follower and a second cam surface are within an elongated slot in said sucker bar.

3. The sucker adjustment device of claim 2 wherein said elongated slot extends from adjacent said sucker cup to adjacent said rotating end.

4. The sucker adjustment device of claim 1 comprising a handle mounted adjacent said distal end for actuating said actuating lever.

* * * * *